US011149763B2

(12) United States Patent
Markert et al.

(10) Patent No.: US 11,149,763 B2
(45) Date of Patent: Oct. 19, 2021

(54) HYDRAULIC ACTUATOR

(71) Applicant: Robert Bosch GmbH, Stuttgart (DE)

(72) Inventors: Christian Markert, Lohr (DE); Emil Hanauer, Abtswind (DE); Johannes Schwacke, Bad Orb (DE); Oleg Stefanjuk, Partenstein (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/290,506

(22) Filed: Mar. 1, 2019

(65) Prior Publication Data

US 2019/0277269 A1 Sep. 12, 2019

(30) Foreign Application Priority Data

Mar. 6, 2018 (DE) ..... 10 2018 203 264.5

(51) Int. Cl.
*F15B 15/18* (2006.01)
*F15B 21/0423* (2019.01)

(52) U.S. Cl.
CPC ..... *F15B 15/18* (2013.01); *F15B 21/0423* (2019.01)

(58) Field of Classification Search
None
See application file for complete search history.

(56) References Cited

U.S. PATENT DOCUMENTS 3,480,076 A * 11/1969 Tomita ..... G05D 23/1931 165/254
3,803,984 A * 4/1974 Lachner ..... F01B 3/0055 91/487
4,075,933 A * 2/1978 Stephens ..... F04B 1/20 91/506
4,164,169 A * 8/1979 Tragl ..... F04B 1/2042 91/504
4,630,441 A * 12/1986 Chamberlain ..... B64C 13/504 60/413
5,144,801 A * 9/1992 Scanderbeg ..... F15B 15/18 60/475
6,979,185 B2 * 12/2005 Kaempe ..... F04C 14/04 418/131
7,055,320 B2 * 6/2006 Nagai ..... B25B 5/061 60/476

FOREIGN PATENT DOCUMENTS

EP 1 508 694 A1 2/2005
WO 03/058034 A1 7/2003

* cited by examiner

*Primary Examiner* — F Daniel Lopez
(74) *Attorney, Agent, or Firm* — Maginot, Moore & Beck LLP

(57) ABSTRACT

A hydraulic actuator includes a cylinder, a pump, an electric motor and a central block. The mechanism or the rotating parts of the pump are directly installed in an interior of the block, and the drive shaft of the pump is correspondingly mounted in walls or in covers of the block.

16 Claims, 7 Drawing Sheets

HYDRAULIC ACTUATOR

This application claims priority under 35 U.S.C. § 119 to patent application no. DE 10 2018 203 264.5, filed on Mar. 6, 2018 in Germany, the disclosure of which is incorporated herein by reference in its entirety.

The disclosure relates to a hydraulic linear actuator.

BACKGROUND

From the prior art, such actuators are known which comprise a cylinder, a pump for supplying the cylinder and an electric motor for driving the pump.

The documents EP 1 508 694 A1 and WO 03/058034 A1 each disclose a hydrostatic machine which can be operated as a pump. Said machine has two so-called mechanisms which are mechanically coupled to one another by means of a common rotating drive shaft. A housing of the machine consists of two shell-type or cup-shaped housing parts. The drive shaft of the two units is mounted in the two housing parts by means of one bearing in each case. In this case, said shaft penetrates only one of the two housing parts. The housing has inner channels, by means of which the two mechanisms are hydraulically interconnected.

The hydraulic linear actuators from the prior art which have already been discussed can be constructed in the form of compact modules, which are also referred to as compact axles. Said actuators have a cylinder having a movable piston rod, a pump for supplying the cylinder and an electric motor for driving the pump. By means of such a module, electrical energy is converted into translational kinetic energy of the piston rod. As a central hydraulic component, a control block is still required, in which control valves and safety valves are received, and on which the connections for the pump and the cylinder are formed. Furthermore, the cylinder and the housing of the pump are attached to the control block.

SUMMARY

Starting from this concept, the disclosure addresses the problem of providing a hydraulic linear actuator in which the number of components is reduced and in which installation space is saved.

This problem is solved by an actuator having the features disclosed herein.

Additional advantageous embodiments of the actuator are further described herein.

The disclosed hydraulic actuator has a cylinder which has a movable piston having a first piston rod which is attached thereto or is formed integrally therewith. The cylinder can be supplied by a pump which can be driven by means of an electric motor.

Furthermore, a hydraulic control block is provided, in or on which connections for the pump and the cylinder are formed. The connections are interconnected by means of channels formed inside the control block. The above-mentioned components are attached to one another in such a way that the actuator is a module or a unit or a compact axle.

According to the disclosure, the pump is arranged in an interior or operational space of the control block. Therefore, the pump housing from the prior art is omitted, thereby reducing the number of components. Furthermore, installation space is saved.

Preferably, control valves and/or safety valves are also arranged in or on the control block.

If the pump is an axial piston pump having a swash plate design, the drive shaft thereof can penetrate a cylinder barrel and, in addition, the interior, and be mounted in the control block on both sides by means of a respective bearing.

Then, a through-opening used as a drive-shaft opening can be provided coaxially with the drive shaft from the interior to an outer face of the control block. Through said through-opening, the drive shaft extends to the electric motor or to a coupling by means of which the electric motor can be coupled to the pump.

In the case of a development of the control block which is simple to mount, the interior is formed in a main body of the control block and closed by means of one or two covers or connecting plates of the control block.

The through-opening to the electric motor or to the coupling is then formed in the cover or in one of the two covers.

The cover or one of the two covers preferably comprises an outer mounting face, to which the electric motor or a support for the electric motor is attached. Preferably, the mounting face surrounds the through-recess.

If the actuator comprises a closed hydraulic circuit and a double-acting cylinder, a storage device is connected to the control block. In this case, the storage device can be attached to the cover or to one of the covers, wherein a storage channel penetrates the cover. The storage device and the storage channel can be arranged concentrically with the drive shaft of the pump.

To cool the pressure medium, a helical cooling line can be arranged in the interior, which line preferably surrounds the cylinder barrel. The cover or one of the two covers comprises connections for said cooling line.

In the variant having the one cover, preferably one of the two bearings is inserted in the cover. In the variant having the two covers, the two bearings are each inserted in one cover.

On an inner face of the cover or of one of the two covers, a distribution baffle assigned to the axial piston pump is particularly preferably formed with two kidney-shaped openings. Openings of the cylinder barrel which are formed in the end face thereof run along said baffle.

Then, two curved working channels can be formed in the cover, which channels connect the kidney-shaped openings to a respective main-body-side orifice by means of a respective cover-side orifice.

The cover or the two covers are preferably produced from cast material.

Then, the curved working channels can be produced by means of 3D-printed sand cores. The additional channels of the cover, such as the concentric storage channel, are then also produced in this manner.

In this case, it is preferable for the curved working channels and optionally the additional channels to be formed with edgeless, flow-optimized junctions.

A leakage connection can open into the interior to the side of the cylinder barrel of the pump, by means of which connection leakage pressure medium is conveyed out of the interior.

Even if an inner wall of the cylinder is formed in the control block, the travel path of the piston is also arranged inside the control block. Therefore, the cylinder jacket component from the prior art is omitted, thereby further reducing the number of components.

If the cylinder is a synchronizing cylinder, the additional piston rod thereof can be moved out of the control block. In a first exemplary embodiment of the actuator according to the disclosure, the additional piston rod extends parallel to the electric motor. A differential cylinder can also be provided.

In a second exemplary embodiment of the actuator according to the disclosure, the electric motor and the first piston rod are arranged so as to be mutually parallel on a first side of the control block. A position measuring system is arranged on a second side of the control block which is opposite the first side. If the storage device is provided, said device is also arranged on the second side in the second exemplary embodiment.

In a third exemplary embodiment of the actuator according to the disclosure, the first piston rod is arranged on a first side of the control block and, in said exemplary embodiment, can be moved out of the first side of the control block, the electric motor and the cylinder are arranged on a second side of the control block which is opposite the first side. If the storage device is provided, said device is preferably also arranged on the second side in the third exemplary embodiment.

BRIEF DESCRIPTION OF THE DRAWINGS

Multiple exemplary embodiments of an actuator according to the disclosure are shown in the drawings, in which.

DETAILED DESCRIPTION

Figure 1:
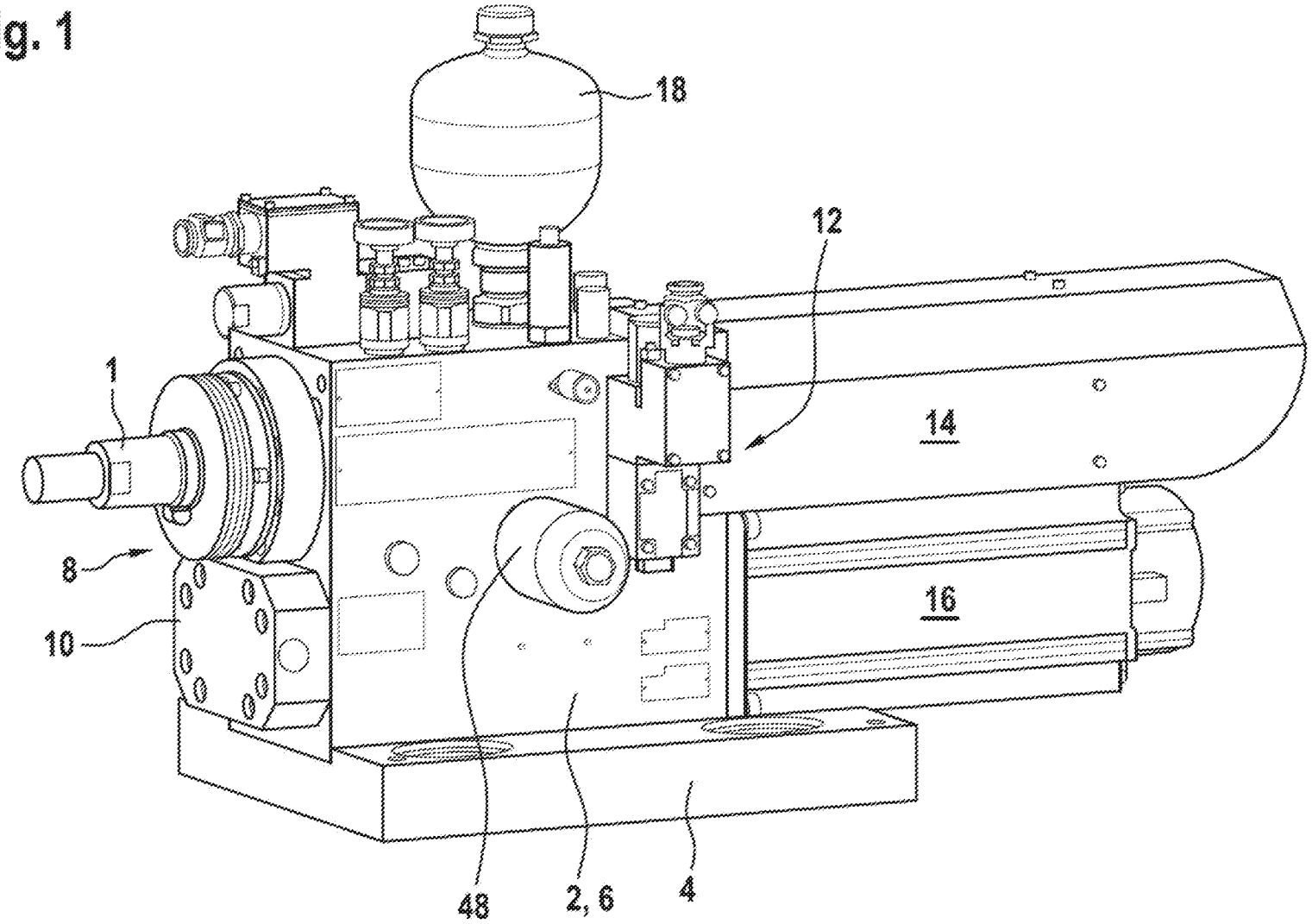
FIG. 1 is a perspective view of a first exemplary embodiment of the actuator according to the disclosure.

FIG. 1 is a perspective view of the first exemplary embodiment of the actuator according to the disclosure. Said actuator is supplied with power and is used to extend and retract a piston rod 1.

As a central component, the actuator has a substantially cuboid control block 2, the main body 6 of which is attached to a base plate 4 of the actuator. The piston rod 1 protrudes out of a first side 8 of the main body 6 and, adjacently thereto, a cover 10 is attached to the main body 6.

On a second side 12, which is opposite the first side 8, a cover plate 14 and an electric motor 16 are arranged so as to be mutually parallel. More specifically, the cover plate 14 has an elongate design, an (imaginary) longitudinal axis of the cover plate 14 being arranged parallel to a drive shaft (not visible) of the electric motor 16.

A storage device 18 is fixed to a side of the main body 6 which is opposite the base plate. Furthermore, various safety and control valves are provided on the main body 6.

Figure 2:
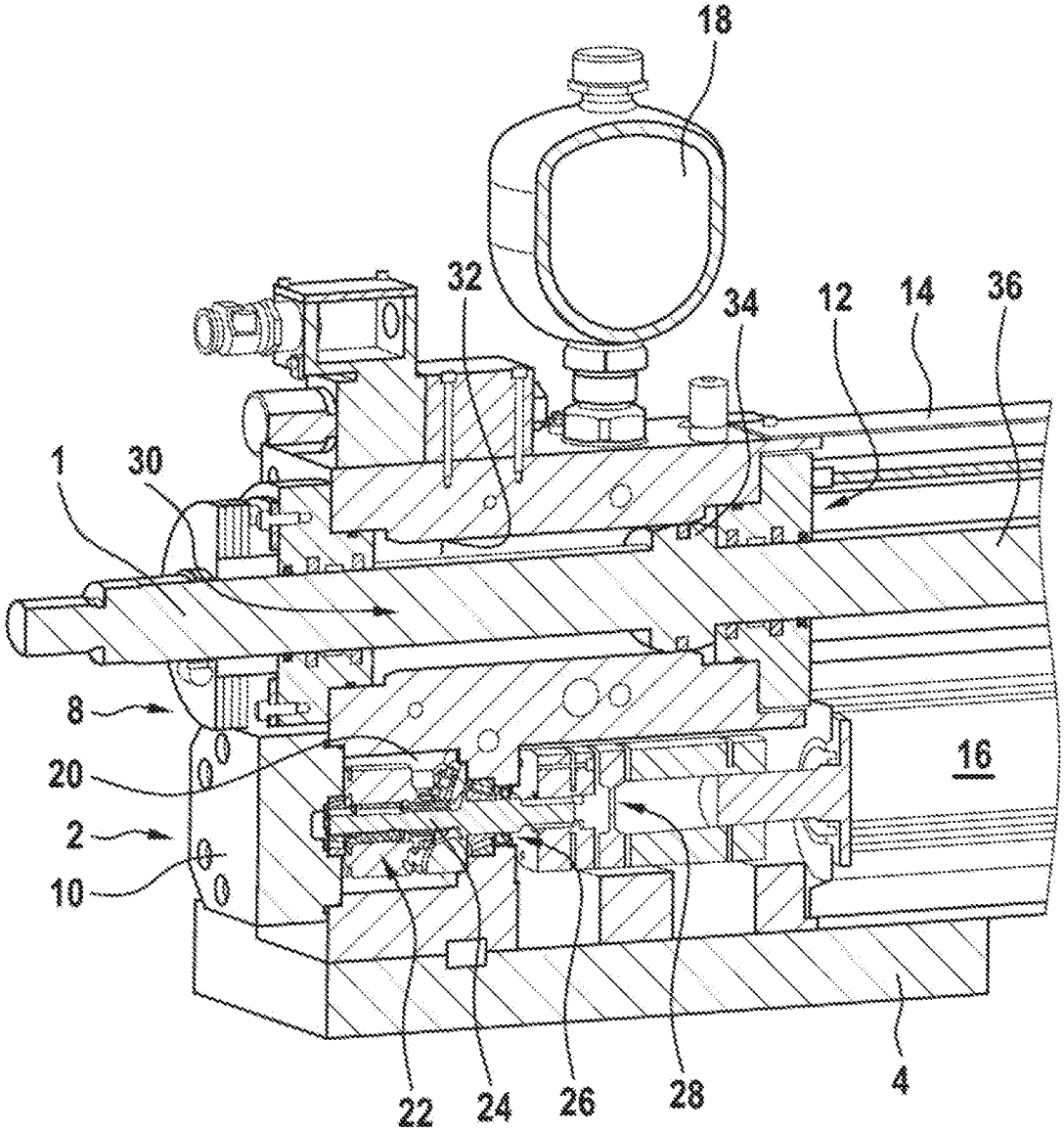
FIG. 2 is a longitudinal sectional view of a detail of the actuator from FIG. 1.

FIG. 2 is a sectional, transparent view of a detail of the actuator from FIG. 1. According to the disclosure, an interior 20 is formed in the main body 6 of the control block 2, which interior is closed on the first side 8 of the main body 6 by the cover 10. In the interior 20, the mechanism of an axial piston pump 22 is received, that is to say a cylinder barrel having pistons guided therein, which pistons are supported on a swash plate. The cylinder barrel and the swash plate are penetrated by a drive shaft 24 of the axial piston pump. The drive shaft 24 also penetrates the interior 20 and in this case is mounted firstly in the cover 10 and secondly in the main body 6 by means of a respective rolling bearing.

Opposite the cover 10, a through-opening 26 is provided in the main body 6, which opening connects the interior 20 of the axial piston pump 22 to a coupling space. Through the through-opening 26 extends the drive shaft 24 of the axial piston pump 22 toward a coupling 28, by means of which the drive shaft 24 can be connected to the electric motor 16 in a rotationally fixed manner.

FIG. 2 further shows that a cylinder 30, more specifically a circular cylindrical inner wall 32, is likewise arranged or formed inside the main body 6 of the control block 2. The cylinder 30 is in the form of a synchronizing cylinder and, integral with first piston rod 1 (mentioned with reference to FIG. 1), has a piston 34 and an additional piston rod 36. A magnetostrictive measuring system is provided in operative connection with the additional piston rod 36 and, together with the additional piston rod 36, is covered by the cover plate 14.

FIG. 2 shows the piston rod 1 in the maximum retracted position thereof, whereby the piston 34 (on the right in FIG. 2) rests on a stop.

Figure 3:
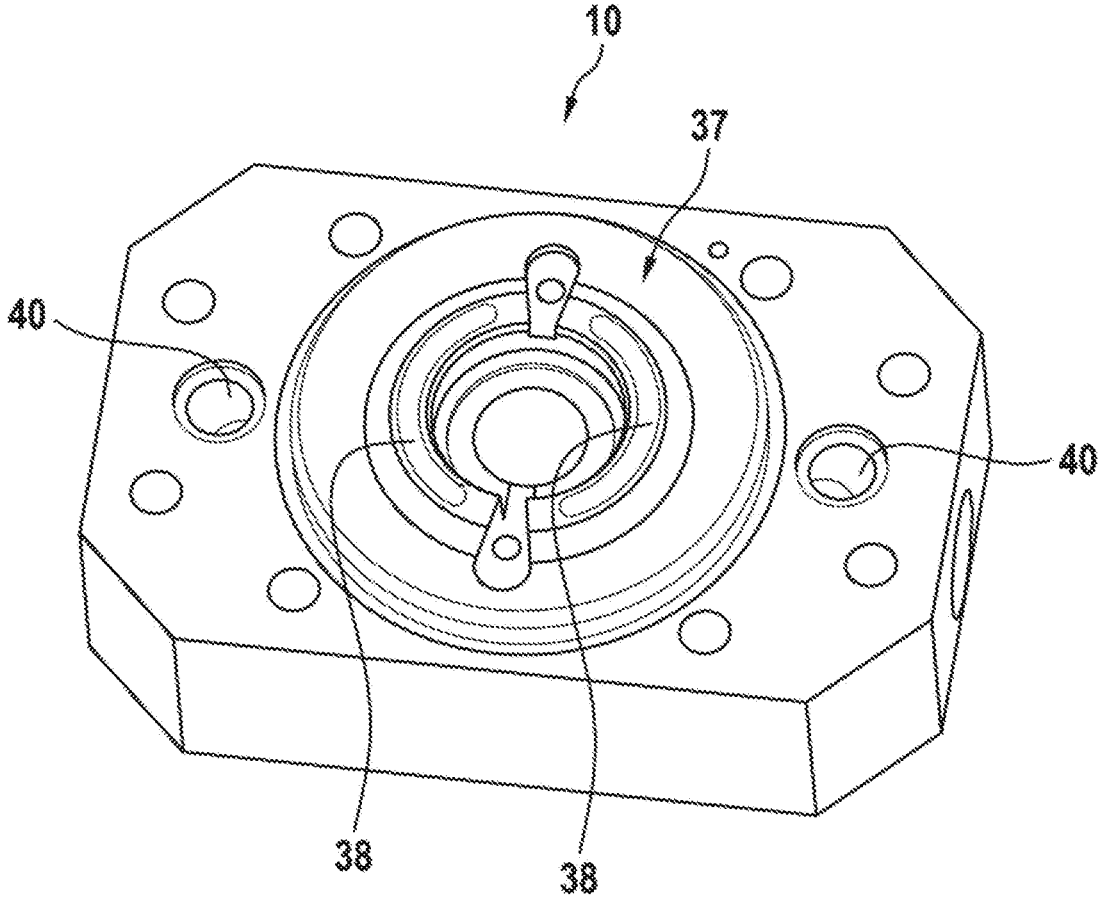
FIG. 3 is a perspective view of a cover of the actuator from FIGS. 1 and 2.

FIG. 3 shows the cover 10 of the actuator from FIGS. 1 and 2. In this case, the side of the cover 10 which faces the interior 20 and thus the axial piston pump 22 is shown. The cover 10 forms the distribution baffle 37 of the axial piston pump 22 having the two kidney-shaped openings 38 provided therein, which baffle is known in principle from the prior art. During the operation of the actuator according to the disclosure and thus of the axial piston pump 22, cylinder channels of the cylinder barrel which are distributed over the periphery run alternately through the two kidney-shaped openings 38, whereby one of the two openings 38 is assigned to the high pressure, and the other of the two openings 38 is assigned to the low pressure.

Each kidney-shaped opening 38 is connected to a radially outer orifice 40, which comes to bear against a respective corresponding orifice in the main body 6, which orifices in turn are connected to a working channel (not shown) which is formed inside the main body 6.

Figure 4:
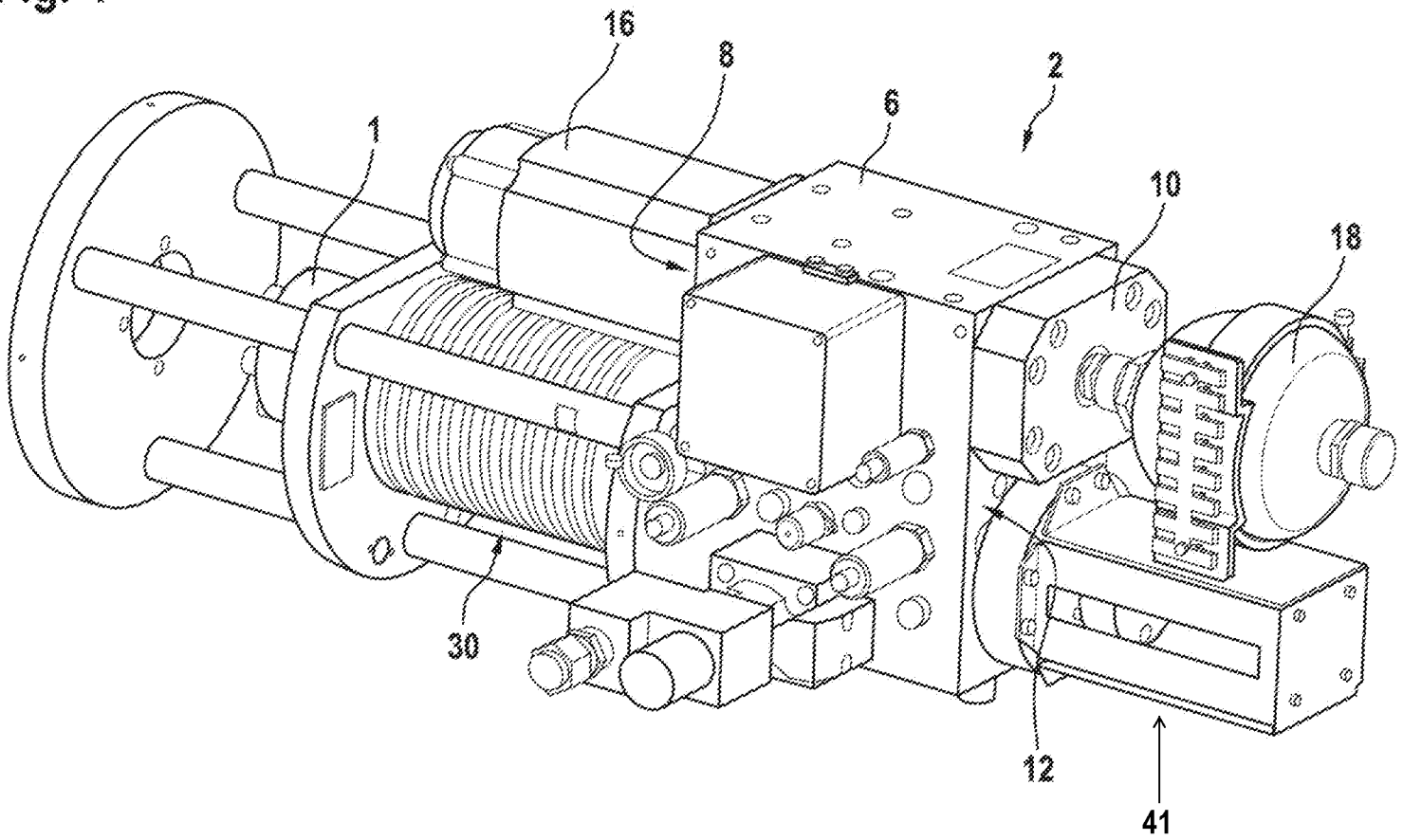
FIG. 4 is a perspective view of a second exemplary embodiment of the actuator according to the disclosure.

FIG. 4 is a perspective view of a second exemplary embodiment of the actuator according to the disclosure. In this case, on the first side 8 of the control block 6, the electric motor 16 is arranged adjacently to the cylinder 30, of which only a head of the piston rod 1 is visible. On the second side 12 which is opposite the first side 8, the cover 10, the storage device 18 and the position measuring system 41 are provided. In this case, the storage device 18 is attached to a central position of the cover 10.

Figure 5:
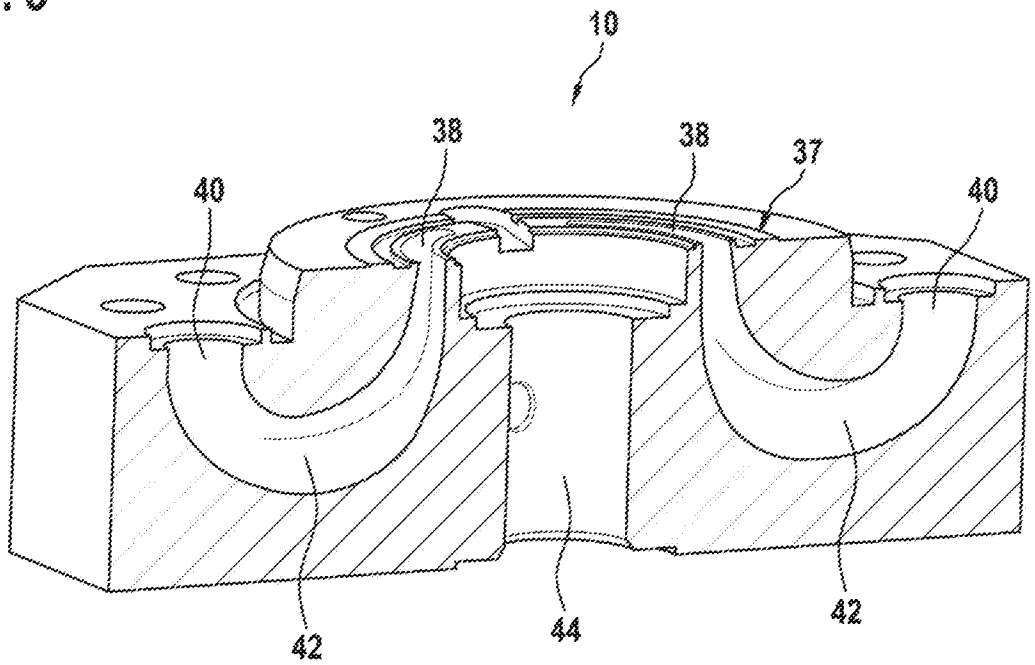
FIG. 5 is a sectional, transparent view of a cover of the actuator from FIG. 4.

FIG. 5 is a sectional, transparent perspective view of the cover 10 of the actuator from FIG. 4. In this case, the distribution baffle 37 corresponds to the two kidney-shaped openings 38, and the two orifices 40 correspond to those in the cover 10 from FIG. 3. In addition, FIG. 5 also shows the respective curved working channels 42, by means of which the kidney-shaped openings 38 are connected to the respective orifices 40. The cover 10 from FIG. 3 also has said working channels 42.

Deviating from the cover 10 from FIG. 3, the cover 10 from the second exemplary embodiment has a central storage channel 44, by means of which the storage device 18 (cf. FIG. 4) is connected to the main body 6 of the control block 2.

Figure 6:
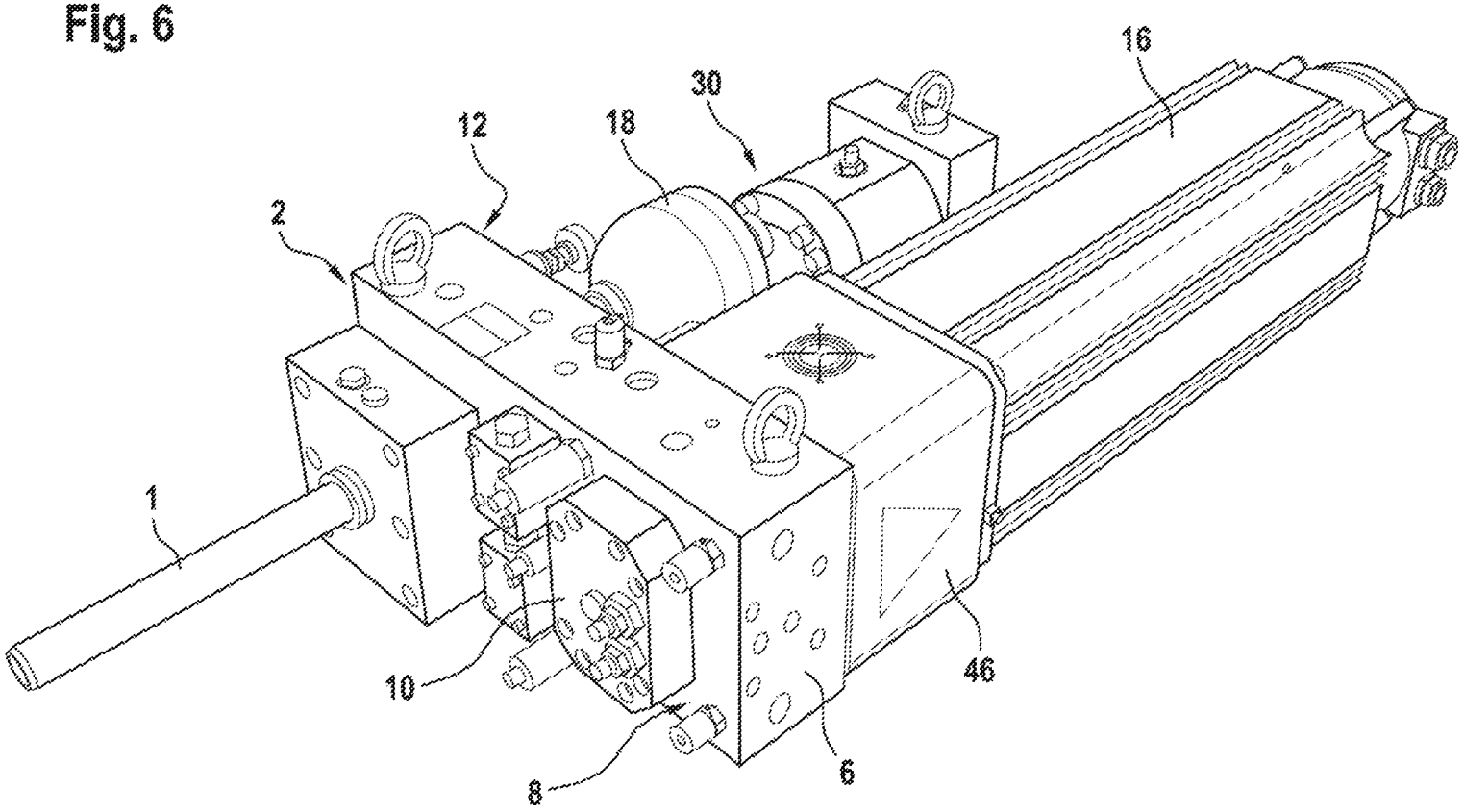
FIG. 6 is a perspective view of a third exemplary embodiment of the actuator according to the disclosure.

FIG. 6 is a perspective view of the third exemplary embodiment of the actuator according to the disclosure. On a first side 8 of the main body 6 of the control block 2, the piston rod 1 and the cover 10 are arranged, whereas on a second side 12, which is opposite the first side 8, the cylinder 30, the storage device 18 and the electric motor 16 are provided.

Between the second side 12 of the control block 2 and the electric motor 16, a coupling housing 46 is provided, in which the coupling is received. Since, in the third exemplary embodiment, the cylinder 30 and the coupling are arranged outside the main body 6 of the control block 2, said main body is smaller than in the first exemplary embodiment.

Figure 7:
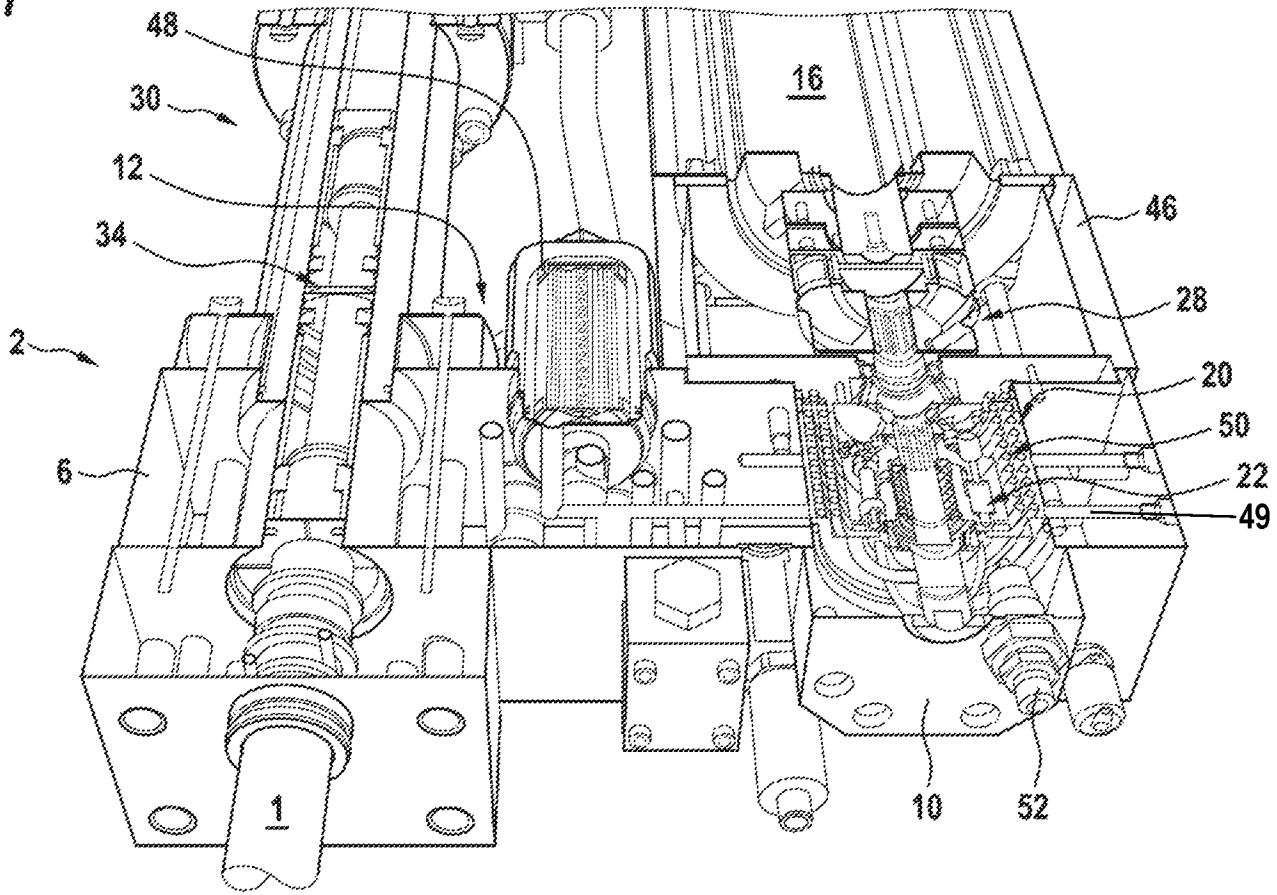
FIG. 7 is a sectional, transparent view of a detail of the actuator from FIG. 6.

FIG. 7 is a sectional, transparent perspective view of a detail of the third exemplary embodiment of the actuator according to the disclosure from FIG. 6. It can be seen that the coupling 28 and the cylinder 30 in the form of a synchronizing cylinder are arranged outside the main body 6 of the control block 2. Furthermore, a filter 48 can be seen, which is likewise arranged on the second side 12 of the main body 6 between the coupling 28 and the cylinder 30.

A leakage connection 49 opens into the interior 20 to the side of the cylinder barrel of the pump 22, by means of which connection leakage pressure medium is conveyed out of the interior 20.

In the interior 20 on the outer periphery of the axial piston pump 22, a cooling device for the leakage oil of the axial piston pump 22 is provided. The cooling device has coiled cooling lines 50 and two connections 52 for coolant formed on the cover 10, only one of the two connections 52 being visible in FIG. 7.

The cover 10 is formed without the central storage channel.

A hydraulic actuator comprising a cylinder 30, a pump 22, an electric motor 16 and a central block 2 is disclosed. The mechanism or the rotating parts of the pump 22 are directly installed in an interior 20 of the block 2, and the drive shaft 24 of the pump 22 is correspondingly mounted in walls or in covers 10 of the block 2.

The invention claimed is:

1. A hydraulic actuator comprising:

a cylinder including a movable piston having a first piston rod;

a pump configured to supply the cylinder, the pump including a cylinder barrel;

an electric motor that drives the pump; and a hydraulic control block, in or on which connections for the pump and the cylinder are formed and which defines channels that interconnect the connections, the hydraulic control block comprising:

a main body defining an interior space, the main body surrounding a portion of the first piston rod; and a first cover having a first side exposed to an exterior of the hydraulic control block and a second side that, along with the main body, defines the interior space in such a way that the first cover closes the interior space, wherein the pump is arranged in the interior space in such a way that the cylinder barrel is exposed to the interior space, wherein the pump is an axial piston pump having a swash plate design, the pump having a drive shaft that penetrates into the interior space and is mounted in the control block by a respective bearing on each side of the interior space, wherein the first cover includes a distribution baffle of the axial piston pump, which includes two kidney-shaped openings defined in the second side of the first cover, and wherein the first cover defines two orifices in the second side of the first cover that connect to the main body and two curved working-channels, each of which curves from a respective one of the two kidney-shaped openings to a respective one of the two orifices so as to connect the respective kidney-shaped opening to the respective orifice.

2. The actuator according to claim 1, wherein the hydraulic control block defines a through-opening that is coaxial with the drive shaft and through which the drive shaft is connected to the electric motor or to a coupling, by means of which the electric motor is configured to be coupled to the pump.

3. The actuator according to claim 2, wherein the hydraulic control block further comprises a second cover defining the interior space and closing the interior space at an opposite end from the first cover.

4. The actuator according to claim 3, wherein the through-opening is defined in the second cover.

5. The actuator according to claim 4, wherein the second cover comprises a mounting face, to which the electric motor or a support for the electric motor is attached.

6. The actuator according to claim 3, further comprising:

a storage device attached to the first cover, wherein a storage channel is defined penetrating the first cover so as to connect the storage device to the main body.

7. The actuator according to claim 1, further comprising:

a cooling line arranged in the interior space and at least partially surrounding the cylinder barrel; and a connection for the cooling line arranged on the first cover.

8. The actuator according to claim 1, wherein:

one of the respective bearings is inserted in the first cover.

9. The actuator according to claim 1, wherein the first cover is formed from cast material.

10. The actuator according to claim 1, wherein the two working channels are formed in the first cover by 3D-printed sand cores.

11. The actuator according to claim 1, wherein the housing control block defines a leakage connection connecting the exterior to the interior space at a side of the drive shaft of the pump.

12. The actuator according to claim 1, wherein the main body of the hydraulic control block defines an inner wall of the cylinder.

13. The actuator according to claim 1, wherein the cylinder includes a second piston rod, which is configured to be moved out of the hydraulic control block and, when moved out of the hydraulic control block, the second piston rod extends parallel to the electric motor.

14. The actuator according to claim 1, wherein the electric motor and the first piston rod are arranged so as to be mutually parallel on a first side of the hydraulic control block that is opposite the first cover, and wherein a position measuring system is arranged on a second side of the hydraulic control block, which is opposite the first side.

15. The actuator according to claim 1, wherein the first piston rod protrudes from a first side of the hydraulic control block, and wherein the electric motor and the cylinder are arranged on a second side of the hydraulic control block which is opposite the first side.

16. The actuator according to claim 1, wherein the curved working channels extend from the respective one of the two orifices to the respective one of the two kidney-shaped channels without any edges.

* * * * *